United States Patent [19]

Redding

[11] 3,975,666

[45] Aug. 17, 1976

[54] PNEUMATIC AND HYDRAULIC CONTROL VALVES

[75] Inventor: Robert J. Redding, Maidenhead, England

[73] Assignee: Skinner Precision Industries, Inc., New Britain, Conn.

[22] Filed: Aug. 5, 1974

[21] Appl. No.: 495,086

[52] U.S. Cl. ..... 317/151; 317/148.5 B

[51] Int. Cl.[2] ..... H01H 47/32

[58] Field of Search ..... 317/DIG. 5, 151, 141 R, 317/141 S; 251/129

[56] References Cited

UNITED STATES PATENTS

| | | | |
|---|---|---|---|
| 2,427,751 | 9/1947 | Snyder | 317/151 |
| 3,121,175 | 2/1964 | Vigneron | 317/DIG. 5 |
| 3,221,174 | 11/1965 | Jacobs | 317/151 |
| 3,382,417 | 5/1968 | Armstrong | 317/151 |
| 3,454,839 | 7/1969 | McIntosh | 317/151 |

FOREIGN PATENTS OR APPLICATIONS

| | | | |
|---|---|---|---|
| 1,117,693 | 11/1961 | Germany | 251/129 |

*Primary Examiner*—J D Miller
*Assistant Examiner*—Harry E. Moose, Jr.
*Attorney, Agent, or Firm*—Prutzman, Hayes, Kalb & Chilton

[57] ABSTRACT

In order to provide intrinsically safe operation of an electromagnetically operated device, such as a pneumatic or hydraulic valve, a circuit in accordance with the invention includes electrical energy storage means, such as a capacitor, which is charged from a source at an intrinsically safe energy level and is subsequently at least partially discharged via switching means through an operating coil of the electromagnetic device. The capacitor is preferably charged from an intrinsically safe d.c. supply via a diode which inhibits discharging of the capacitor back into the d.c. supply. The switching means preferably operates to connect the capacitor to the operating coil when the charge on the capacitor reaches a predetermined level, as determined by a voltage sensitive device which responds to the capacitor voltage. The circuit may be used to operate a valve of the latching type having two operating coils connected in series, the capacitor being discharged through both of said coils to set the valve, the circuit including a second storage means connected in series with the coils and means for discharging the second storage means through one of the coils to reset the valve. The second storage means may be charged from the first storage means in a succession of steps.

4 Claims, 2 Drawing Figures

PNEUMATIC AND HYDRAULIC CONTROL VALVES

This invention relates to circuits for causing operation of electromagnetically operated devices such as control valves for pneumatic and hydraulic circuits, for use in locations where there is a fire and/or explosion hazard.

The preferred method of safe-guarding electrical equipment in the presence of hazardous atmospheres is to make the electrical circuit intrinsically safe. This requires that the energy level in the circuit is at all times below a critical value, so that any sparks resulting therefrom are not of sufficient energy to ignite the atmosphere.

The electrical circuit for causing operation of a solenoid valve in hazardous conditions must therefore operate at a low electrical level. In practice it is found difficult to design a solenoid which will operate at a low energy level and still satisfactorily cause operation of a pilot valve in a high pressure pneumatic or hydraulic system.

It is an object of the present invention to provide an intrinsically safe circuit for causing operation of an electromagnetic device.

In accordance with the present invention the circuit includes energy storage means which is charged from a source at an intrinsically safe energy level and is subsequently at least partially discharged via switching means through an operating coil of the electromagnetic device.

Figure 1:
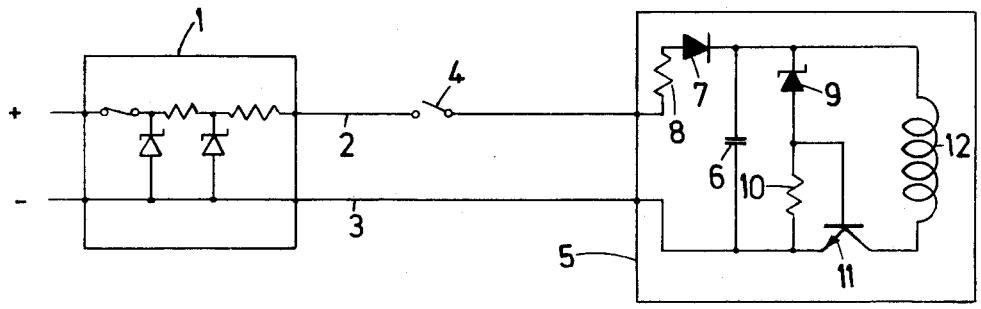
Figure 2:
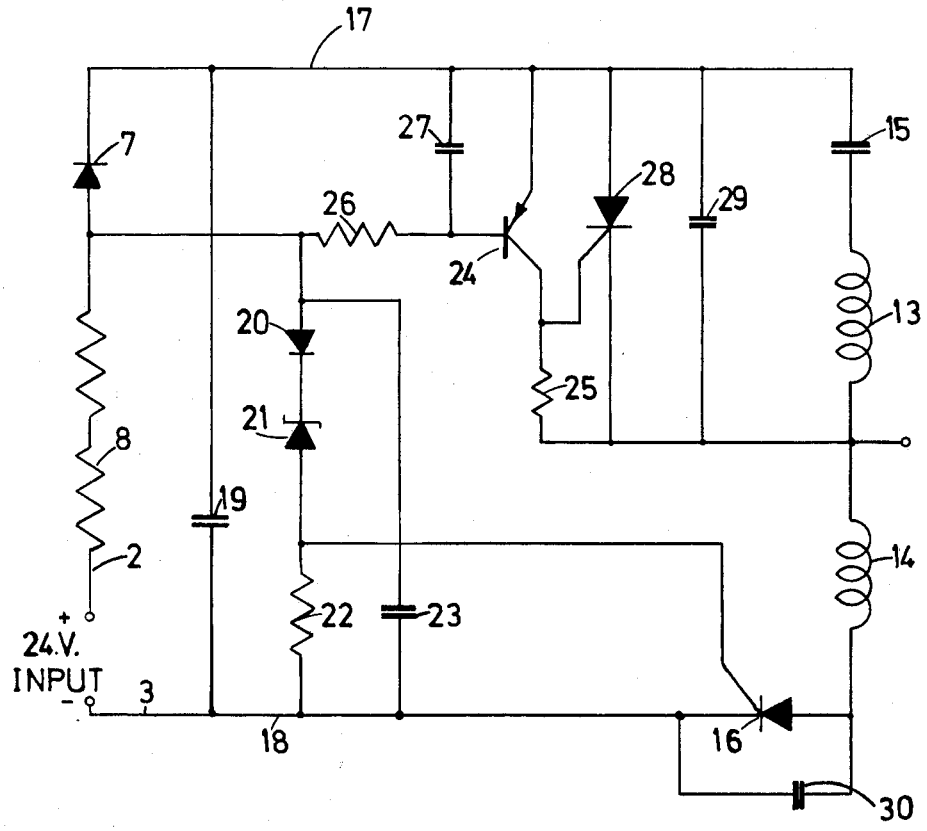

Embodiments of the invention will now be described, by way of example, with reference to the accompanying drawings, in which FIG. 1 is a circuit diagram showing one form of circuit in accordance with the invention together with a safety barrier, and FIG. 2 is a circuit diagram of an alternative form of circuit in accordance with the invention.

Many magnetic devices require a considerably larger amount of power to initiate movement of the armature or other moving part to a closed position than is required to hold the armature or other part in that position. The ratio of pull-in energy to hold-in energy may, for example, be 10 : 1. For example, a typical solenoid valve which operates a pilot may require a current of not less than 100 mA to pull in the solenoid, whereas a current of 10 or 20 mA may be quite adequate to hold it in.

Considering such a solenoid which requires a current of not less than 100 mA at 12v, this is about the maximum safe energy level which can be permitted in a hazardous atmosphere where hydrogen may be present. However, it is very difficult to provide such a power level from an intrinsically safe source, since this level must not be exceeded under any fault or overload conditions which might occur in the circuit. In practice, the amount of energy safely available from a conventional circuit for the operation of the valve or other device is no more than half of this value, and consequently reliable operation of the device cannot be guaranteed.

An example of a circuit in accordance with the invention for causing operation of an electromagnetically operated device which requires a relatively high pull-in power and a lower hold-in power is shown in FIG. 1 of the drawings. Referring to that Figure, a safety barrier 1, such as a zener diode barrier circuit as described in my U.S. Patent No. 977,913, is connected between a d.c. source and a supply line 2 and 3 which is connected to the electromagnetic device via a switch 4. The safety barrier 1 preferably comprises a network of resistors and zener diodes which are arranged to ensure that in spite of any occurrence on the safe side of the barrier, i.e. the lefthand side in FIG. 1, the power delivered to the lines 2 and 3 in a danger area will be intrinsically safe, provided that the lines 2 and 3 and any circuit 5 connected thereto does not have values of inductance and capacitance which exceed certain design values.

The circuit 5 comprises a capacitor 6 of, for example, several thousand $\mu$F capacitance, which is connected across the lines 2 and 3 via a diode 7 and a series resistor 8. A series circuit comprising a zener diode 9 and a resistor 10 is connected across the capacitor 6, the junction between the resistor and capacitor being connected to the base electrode of a transistor 11. An operating coil 12 of an electromagnetic device, such as a solenoid valve, is connected in series with the collector/emitter circuit of the transistor 11, across the capacitor 6. The whole of the circuit 5 may be encapsulated.

In operation of the circuit, when the switch 4 is closed, the capacitor 6 starts to charge from the d.c. source via a resistor 8 and the diode 7. The voltage across the capacitor 6 rises rapidly towards the no-load voltage of the power supply. Until the zener voltage of the diode 9 is reached, this diode is non-conductive and the voltage across the resistor 10 remains at zero. The transistor 11 therefore remains biased-off so that no current flows through the coil 12.

When the zener voltage of the diode 9 is reached and the diode conducts, a voltage appears across the resistor 10 due to the diode current, therefore making the base electrode of the transistor 11 positive with respect to its emitter. The transistor therefore conducts, and a large pulse of current flows from the capacitor 6 into the coil 12. This current is sufficient to pull-in the solenoid. Thereafter, the current through the coil remains at a steady lower level until the switch 4 is opened. This lower level is sufficient to hold-in the solenoid, and the hold-in current can be fed continuously to the coil 12 in an intrinsically safe manner.

It will be noted that the current fed to the coil 12 by this circuit is much higher than would be the case if the capacitor 6 were not present. The circuit, which in the absence of the capacitor 6 would produce perhaps only tens of mA for feeding the coil 12 can, by virtue of the capacitor 6, produce a current pulse of the order of 1A for operation of the solenoid. Furthermore, the current available is not determined by the length of the leads connecting the circuit with the power source, since the capacitor 6, which is situated only a very short distance from the coil 12, acts as the source of pull-in current.

The encapsulation of the circuit 5 ensures intrinsic safety of the circuit, and the resistor 8 and the diode 7 ensure that no charge from the capacitor 6 passes back along the lines 2 and 3 where a dangerous spark could be caused.

Although a capacitor 6 is used in the above embodiment to act as a storage element, other devices such as electrolytic cells or even secondary cells of the nickel-cadmium type may be used for the purpose. Similarly, other types of semi-conductor switching devices or even mechanical relays may in some instances be used in place of the transistor 11. Furthermore, although the coil 12 is said to be the solenoid of a hydraulic valve, other forms of mechanically-operated devices may be energised in the same manner. Similarly, although described on the basis of automatic operation of the circuit at a particular voltage level set by the diode 9, the storage element could transfer its charge into the coil 12 on receipt of a signal from another source. The zener diode might be replaced by any other suitable voltage-sensitive device, such as a thermister.

The circuit shown in FIG. 2 is suitable for use with a known latching solenoid valve or other type of magnetic latching device of the kind which is switched on by one electrical pulse and is switched off by another pulse, no power from an electrical source being needed to hold-in the device.

Referring to FIG. 2, the latching device has two coils 13 and 14 which are connected in series with a capacitor 15 and a thyristor 16 across d.c. supply lines 17 and 18 which are fed from lines 2 and 3 via resistor means 8 and diode 7 as in the previous embodiment.

A capacitor 19 is connected across the lines 17 and 18. A series resistance/diode network is connected between the line 18 and the junction of the resistor 8 and the diode 7, the network comprising a diode 20, a zener diode 21 and a resistor 22. A capacitor 23 is connected across the network.

The gate of the thyristor 16 is connected to the junction of the resistor 22 and the diode 21.

A transistor 24 is connected, via a collector resistor 25, across the coil 13 and the capacitor 15, the emitter of the transistor being connected to the line 17. The base of the transistor 24 is connected via a resistor 26 to the junction between the diode 7 and the resistor 8. A capacitor 27 is connected between the base and the emitter of the transistor 24.

The collector of the transistor 24 is connected to the gate of a thyristor 28, which is connected across the coil 13 and the capacitor 15. A capacitor 29 is connected in parallel with the thyristor 28, and a capacitor 30 is connected in parallel with the thyristor 16.

In operation of the circuit, the application of the 24v supply to the lines 2 and 3 charges the capacitor 19 through the resistor 8 and the diode 7. When the voltage on the capacitor 19 reaches approximately 22.5v, the diode 21 begins to conduct, thereby passing current to the gate of the thyristor 16. The thyristor 16 is triggered, and the capacitor 19 discharges through the capacitor 15 and the coils 13 and 14. The current pulse in these coils operates the valve.

In order to provide two-wire operation using standard three-wire connections, for the coils 13 and 14, a voltage is obtained across the capacitor 15 in the following manner. The initial discharge of the capacitor 19 charges the capacitor 15 to approximately 10v, and the thyristor 16 turns off because current is no longer flowing through the zener diode 21. The capacitor 19 recharges to approximately 22,5v, the thyristor 16 is triggered again, the capacitor 15 is charged to a higher voltage, the thyristor 16 turns off again, and the cycle is repeated several times until the capacitors 19 and 15 are both charged to approximately 22.5v. The latter voltage is limited by the current flowing through the safety barrier (as in FIG. 1), the resistor 8, the diode 7, the zener diode 21 and the gate of the thyristor 16.

When the supply voltage is switched off and a short-circuit is connected across the lines 2 and 3, current ceases to flow through the gate of the thyristor 16 which therefore turns off, and current is conducted through the resistor 26 and the base of the transistor 24 from the capacitor 19, which is still charged. The resulting collector current of the transistor 24 turns on the thyristor 28, which discharges the capacitor 15 through the coil 13. The current pulse through this coil resets the valve to its original position.

If the short-circuit across the lines 2 and 3 is maintained, the capacitor 19 will discharge slowly through the resistor 26, this current being similar in magnitude to the internal leakage in the capacitor. The capacitor 19 retains most of its charge for several minutes, which makes the next operation quicker than the initial one.

The capacitors 23, 27, 29 and 30 are small value capacitors which help to prevent the thyristors from being triggered spuriously.

It will be seen that the valve remains in its present state in the event of a power supply failure. However the valve can be provided with means for unlatching it manually or automatically since sufficient energy is stored in the capacitor 15. The circuit shown in FIG. 2 for pulsed magnetic latch operation can also be used for a valve which has a magnetic hold-on feature, e.g. by means of a permanent magent. The valve requires a magnet "boost" or "buck" to operate "on" and "off" and this is provided if the single coil 13 is connected, no coil 14 being required in this instance.

In the description above, the capacitors 6 in FIG. 1, and 19 and 15 in FIG, 2 are charged to a voltage approaching that of the intrinsically safe supply. However, the safe supply could be stepped up to a higher voltage by means of an inverter located within the encapsulated circuit 5, between the diode 7 and the capacitors.

I claim:

1. An intrinsically safe electrical circuit adapted to control the operation of an electromagnetically-operated device, including a safety barrier connected to a source, electrical energy storage means which is charged from said source through said safety barrier at an intrinsically safe energy level and is subsequently at least partially discharged via switching means through an operating coil of said electromagnetic device and second energy storage means operable to discharge through said operating coil of said device upon failure of the source of power to said first energy storage means.

2. An intrinsically safe electrical circuit adapted to control the operation of an electromagnetically-operated device having two operating coils in series, including a safety barrier connected to a source, first electrical energy storage means which is charged from said source through said safety barrier at an intrinsically safe energy level and is subsequently at least partially discharged by a switching means through both said operating coils to set said device, a second energy storage means connected in series with said coils and arranged to be charged from said source through said safety barrier and means for discharging said second energy storage means through one of said coils to reset the device.

3. A circuit as claimed in claim 2, in which said second storage means is charged from said first storage means in a succession of steps, said first storage means being recharged between said steps.

4. A circuit as claimed in claim 3, in which said means for discharging said second storage means comprises a thyristor.

* * * * *